United States Patent [19]

Barsi et al.

[11] 4,340,254

[45] Jul. 20, 1982

[54] METHOD OF MINING HEAVY COAL SEAMS IN TWO OR MORE BENCHES

[75] Inventors: Károly Barsi; László Dörömbözi; István Forisek; Gyula Kuburczik; György Stuber, all of Tatabánya, Hungary

[73] Assignee: Tatabányai Szénbanyák, Tatabánya, Hungary

[21] Appl. No.: 121,046

[22] Filed: Feb. 13, 1980

[30] Foreign Application Priority Data

Feb. 14, 1979 [HU] Hungary ..... TA 1509

[51] Int. Cl.[3] ..... E21C 41/00; E21F 15/00

[52] U.S. Cl. ..... 299/11; 405/267

[58] Field of Search ..... 299/11

[56] References Cited

U.S. PATENT DOCUMENTS 1,233,301 7/1917 Bartlett ..... 299/11
4,059,963 11/1977 Wayment ..... 299/11
4,198,097 4/1980 Fondriest ..... 299/11

FOREIGN PATENT DOCUMENTS 1156036 10/1963 Fed. Rep. of Germany ..... 299/11
2216039 9/1976 Fed. Rep. of Germany .

*Primary Examiner*—Ernest R. Purser
*Attorney, Agent, or Firm*—Karl F. Ross

[57] ABSTRACT

In mining a heavy coal seam that must be excavated in several benches, the excavation of the uppermost bench is accompanied by the introduction of a cementitious slurry into the resulting stope for consolidating the waste rock present therein, preparatorily to the excavation of the next-lower bench, and proceeding in like manner with the second bench if a third one is to follow. The cementitious slurry comprises burnt or slaked lime, and/or portland cement, suspended in water in a quantity of about 10 to 60% by weight and preferably together with a small percentage of chlorides of one or more alkali or alkaline-earth metals, to which ceramic aggregates at large specific surface such as mineral ashes, slag, sand or dolomite powder may be added in a quantity of up to about 30% of the weight of the water. The slurry, on being admitted to the stope in an amount of at least 10% of the volume thereof, causes the waste rock to swell and to form a solid layer of up to approximately a meter in thickness which allows the next-lower bench to be excavated after only about a month's delay.

11 Claims, 5 Drawing Figures

METHOD OF MINING HEAVY COAL SEAMS IN TWO OR MORE BENCHES

FIELD OF THE INVENTION

Our present invention relates to a method of mining heavy coal seams which require excavation in two or more benches at different levels.

BACKGROUND OF THE INVENTION

In such multilevel excavations it is necessary to delay the start of operations at a lower level until well after the excavation of an upper level has been completed in order to give the caved-in overburden and the fragmented rocks in the stope of the upper level time to subside or settle into a solid structure forming a competent roof for the next-lower stope. Such a subsidence period often lasts about one to three years, depending on local conditions and official safety requirements.

The drawbacks inherent in this conventional mode of operation are manifold. Thus, the residual coal present in the loose rock structure of the upper stope may spontaneously ignite, especially in mines endangered by firedamp. Considerable expenditures are involved in measures designed to guard against serious catastrophes which, however, cannot be definitely prevented. During this waiting period, furthermore, the main galleries of the mining area and other subterranean facilities such as pumping chambers, transformer stations, power supplies and ventilation systems must be maintained, again at considerable cost and with much effort. The delay, obviously, keeps the mine output low; moreover, the theoretical excavation rate is reduced since work underneath a caved-in stope cannot be carried out as efficiently as under virgin overburden so that the rate of excavation at the lower level is diminished by about 30 to 60%. Finally, additional safety measures are generally needed even after a long subsidence period to ensure a sufficient firmness of the roof at the lower level.

According to a prior proposal, a cutting and loading machine working on a mine face of an upper bench entrains a mat of wire netting to intercept the fragmented rock. The mat and the rock fragments serve as a supplemental roof for the next-lower level, yet this technique is not free from problems of operation and safety. Thus, the correct emplacement of the mat in the wake of the excavating machine is complicated; even with proper positioning, the mat can only lessen the impact of dropping clumps of overburden upon the underlying rock structure forming the roof of the next-lower stope but cannot densify or consolidate the rubble in the upper stope and thus does not significantly contribute to the stability of the structure. Experience has also shown that the mat will withstand only limited impact and will be torn by blocks of several tons of overburden falling upon it; this may result in serious difficulties for the operations going on at the lower level. Furthermore, the mechanical stresses and dislocations caused by this method on the floor of the upper stope could promote spontaneous ignition and might result in undetected fires smoldering under the loosely piled rock fragments.

The use of liquid bonding agents to help solidify the roof or the walls of an underground vault is also known. A composition of this type, known as shotcrete, consists of a mixture of comminuted portland cement, sand and water and can be sprayed onto a tunnel wall to fill small voids between rock fragments. Another hydraulic bonding agent, described in German printed specification No. 2,216,039, comprises granular natural anhydrite and gypsum semihydrate in a certain quantity of water, to which an activator may be added. Conventional techniques for using these compositions cannot be readily utilized for reinforcing a stope, formed during excavation of a coal bench under a previously excavated and caved-in level, to prevent its premature collapse.

OBJECTS OF THE INVENTION

The general object of our present invention, therefore, is to provide an improved method of mining heavy coal seams in two or more benches with avoidance of the above-discussed drawbacks.

A more particular object is to provide a method of this character which utilizes inexpensive and abundantly available substances for its implementation.

SUMMARY OF THE INVENTION

In the mining of a coal seam pursuant to our present invention, a conventional initial step of excavating an upper bench with formation of a stope in the wake of the excavation is followed by the introduction of a cementitious slurry into that stope in an amount upwards of substantially 10% of that volume, this slurry comprising an aqueous suspension of calcareous matter, in a proportion of substantially 10 to 60% by weight, to flood and engulf fragmented waste rock accumulating at the bottom of the stope. After the hardening of the slurry and the engulfed waste rock into a solid layer, the next-lower bench under that layer is excavated. A similar layer is formed in the wake of the latter excavation if this step, in its turn, is to be followed by further excavating on a still lower level, and so on.

In most instances, an amount of slurry ranging between about 20 and 25% of the stope volume will be highly satisfactory.

The surprising effect of consolidation of the bottom of the upper stope, which generally allows the start of operations at the next-lower level after a delay on the order of one month instead of one or more years, is due to the fact that the fine fraction of the fragmented overburden (having a particle size of less than 1 mm) acts as a hydraulic aggregate in the cementitious slurry. This fraction generally accounts for about 5 to 10%, by volume, of the overall amount of waste rock collapsing onto the stope bottom. The composition of the overburden or capping, of course, plays a part in the cohesiveness of the resulting layer. The usual constituents such as clay, sand and the various types of marl can all be consolidated when present in the rock fragments. Shell marl is particularly advantageous in this respect since the calcium carbonate of the fossil snail shells enhances the solidification. We have found that the rock fragments permeated by the cementitious slurry not only cohere but are also internally consolidated. Thus, the larger fragments are initially plastified and begin to swell under the effect of the liquid and, together with the intervening similarly expanding finer fractions, form a nearly air-impermeable stratum which hardens like concrete. The presence of this hardened layer, the moisturizing and heat-absorbing effect of the treatment liquid, and the sealing of virtually all air passages combine to minimize the risk of spontaneous ignition. This concrete-like layer, which may have a thickness between about 10 cm and 1 m, is of great load-bearing capacity found to increase even further under external pressure as the overburden in the abandoned part of the stope caves in on it.

A preferred range of the proportion of calcareous matter in the water of the suspension is between about 20 and 40% by weight. With this suspension we may admix a chloride of one or more alkali or alkaline-earth metals in a proportion between substantially 0.3 and 6% by weight, again with reference to the water, preferably with a lower limit of about 0.8% and an upper limit of about 3%; this admixture not only accelerates the hardening process but is also found to increase both the initial and the final compression resistance of the layer.

In some instances, as where there is an insufficient amount of shell marl in the rock or where limestone rock produces only a small amount of fine-grain fraction, the suspension may be enriched with ceramic aggregates of large specific surface such as cinders or slag readily available from the boilers of an associated power plant. Other aggregates of this type include sands and dolomite powder. The comminuted aggregates may be added in a proportion of about 5 to 30%, preferably 15 to 20%, by weight with reference to the water of the suspension.

The cementitious slurry, with the added aggregates (if any), may be prepared on the surface or underground and can be fed in by gravity and/or by pumping. To promote densification, the rubble inundated by this slurry is subjected to mechanical agitation, such as vibration.

To test the effectiveness of our improved method, samples of the consolidated rock fragments (impregnated with the slurry in an amount of 20% by volume, referred to the volume of the stope) were subjected to a load corresponding to that of a caved-in stope. After a loading for 30 days, the one-way breaking strength of these samples was measured.

A series of such tests was performed with Lumachelle-type capping, this being a rock characterized by a high content of $CaCO_3$ of nonuniform distribution. The calcium carbonate was found to be particularly prevalent around the mother rock whereas clay or occlusions of bituminous coal predominated elsewhere.

| | | |
|---|---|---|
| A. | (tough calcium-rich sample) | |
| | $CaCO_3$ | 86.5% |
| | $MgCO_3$ | 2.1% |
| | residual slurry | 11.4% |
| B. | (less calcium-rich sample) | |
| | $CaCO_3$ | 66.0% |
| | $MgCO_3$ | 1.4% |
| | Residual slurry | 32.6% |
| C. | (average composition) | |
| | carbonate content | 82.0% |
| | residual slurry | 18.0% |

The one-way breaking strength in kp/cm$^2$ (kp=kilopond, or kilogram-force) is about 50 for coal and about 150 for the unperturbed overburden. Corresponding values found for samples treated with different compositions of slurry in accordance with our invention are given in the following table:

| | Composition of Slurry in Percent by Volume of Water | | | |
|---|---|---|---|---|
| Sample No. | Portland Cement | Slaked Lime | $MgCl_2$ | Breaking Strength in kp/cm$^2$ |
| 1 | 22.0 | — | 0.75 | 116 |

-continued

| | Composition of Slurry in Percent by Volume of Water | | | |
|---|---|---|---|---|
| Sample No. | Portland Cement | Slaked Lime | $MgCl_2$ | Breaking Strength in kp/cm$^2$ |
| 2 | 34.0 | — | 1.20 | 167 |
| 3 | 18.0 | 4.0 | 0.75 | 102 |
| 4 | 26.0 | 8.0 | 1.20 | 145 |

It will thus be seen that the breaking strength after a 30-day stand under load comes close to and in some instances even surpasses that of the virgin overburden besides meeting the requirements of technological feasibility and operational safety.

BRIEF DESCRIPTION OF THE DRAWING

The above and other features of our present invention will now be described in detail with reference to the accompanying drawing in which.

SPECIFIC DESCRIPTION

Figure 1:
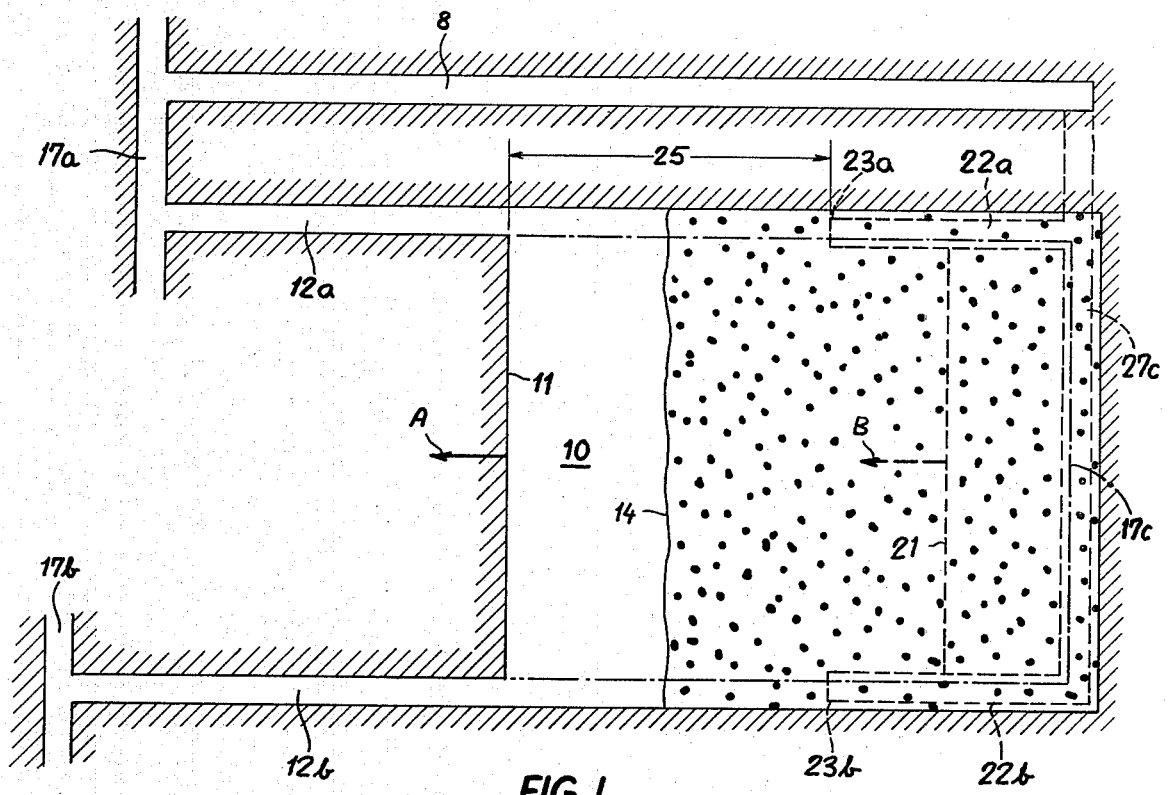
FIG. 1 is a plan view schematically illustrating a two-level excavation of a coal seam in accordance with our invention.
Figure 4:
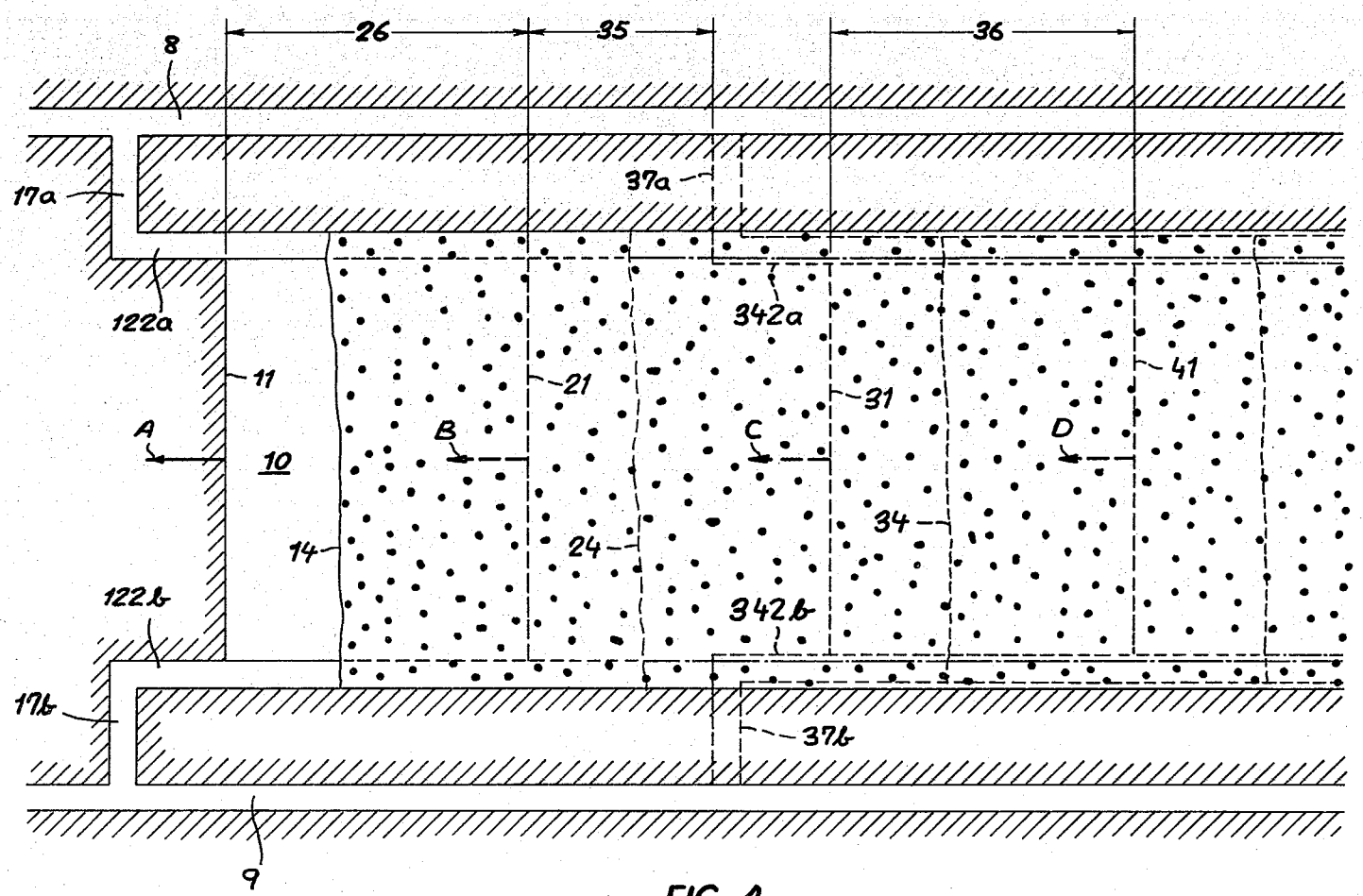
FIG. 4 is a view similar to FIG. 3 but illustrating a modification similar to that of FIG. 2.
Figure 5:
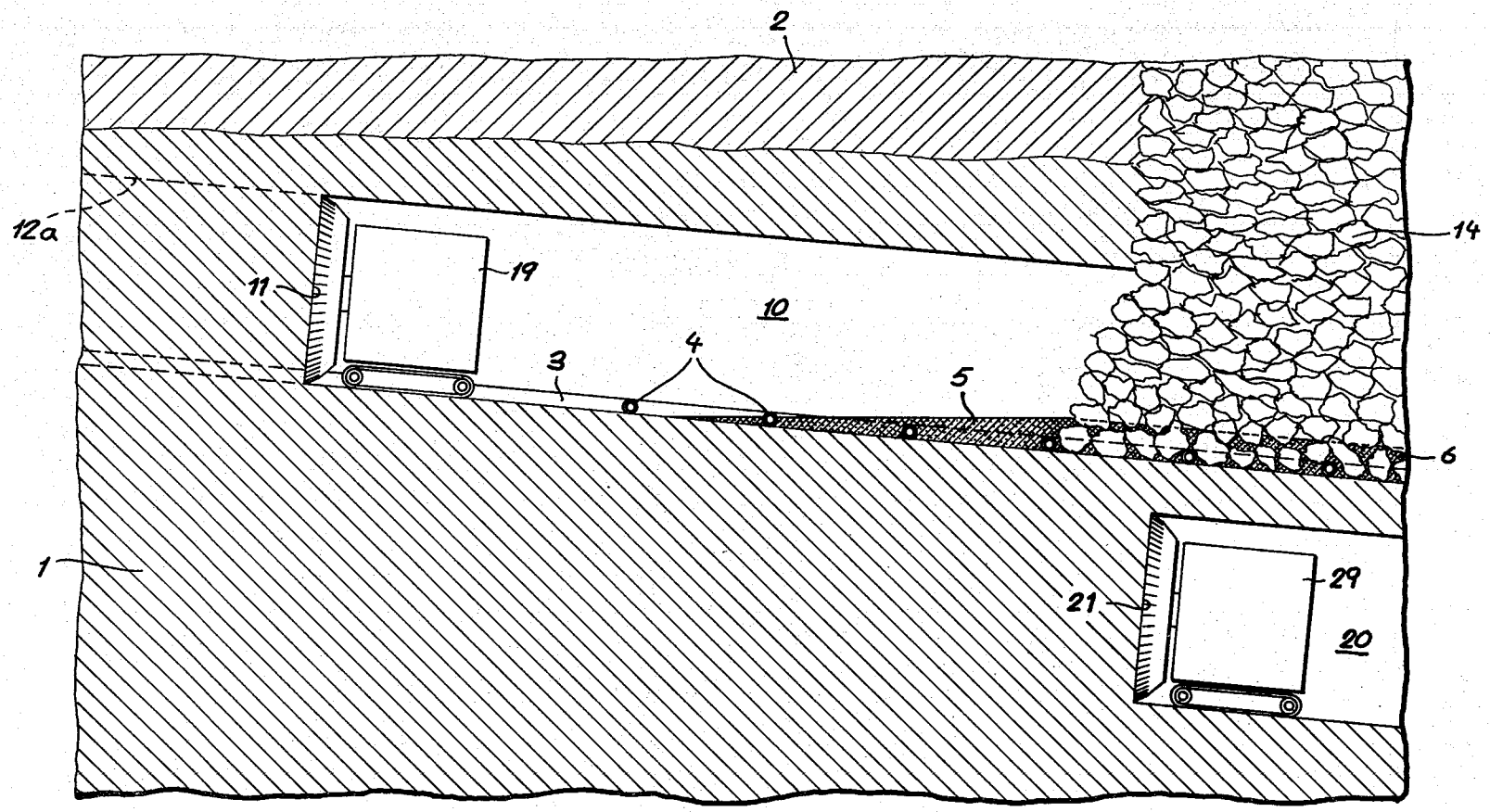
FIG. 5 is a cross-sectional view of a coal seam being excavated in the manner illustrated in FIG. 1.

Reference will first be made to FIGS. 1 and 5 in which a coal seam 1 (FIG. 5), overlain by bedrock 2, is to be mined on two levels by the so-called longwall method. At the upper level, two parallel galleries 12*a* and 12*b* are built to communicate via cross-cuts 17*a* and 17*b* with a main gallery 8 and a ventilating duct 9, the latter being shown only in FIGS. 3 and 4. Excavation starts at a cross-cut 17*c*, interconnecting the two galleries 12*a* and 12*b*, to produce a mine face 11 progressing in the direction of an arrow A. The excavating and loading equipment working on that mine face has been schematically indicated at 19 in FIG. 5.

A pipeline 3 at the bottom of gallery 12*a* carries slurry from a nonillustrated underground or surface source. As the face 11 progresses, the crew handling the equipment 19 connects perforated branch pipes 4 to line 3 at locations spaced about 20 to 50 meters apart in the stope 10 being formed. The roof of the stope is supported in the usual manner by temporary props, not shown, which are subsequently withdrawn to let the overburden cave in at a safe distance from the mine face 11 as indicated at 14. Prior to this cave-in, however, slurry 5 exiting from the branch pipes 4 has formed a pool at the bottom of the stope which engulfs accumulating fragments of waste rock and consolidates them into a concrete-like layer 6 as described above. As the excavation progresses, the flow of slurry is cut off just ahead of the sections of pipeline 3 about to be buried by the cave-in.

Additional slurry may be fed into the stope 10, if desired, from hoses carried by the excavating equipment 19.

After the hardening of layer 6 under the caved-in overburden 14, a second excavation is commenced at a lower level with lateral galleries 22*a* and 22*b* moving forward from a cross-cut 27*c* which extends at that level from the main gallery 8; the ends 23*a*, 23*b* of these lower galleries are separated from upper face 11 by a distance 25. Excavating and loading equipment 29, working on a face 21, thus produces a lower stope 20 underneath the consolidated layer 6. The excavation of the lower bench along face 21 lags that of the upper bench along face 11 with a delay of about one month. The advance of lower face 21, trailing the gallery ends 23*a*, 23*b*, has been indicated by an arrow B.

If desired, the roof of stope 20 can be further consolidated by the pumping of additional slurry into apertures drilled from the stope 20 into the overhanging coal and/or rock structure.

Galleries 22*a* and 22*b* must, of course, be kept open during the entire excavation of the lower bench for ventilation, haulage, and traffic by men and machines.

Figure 2:
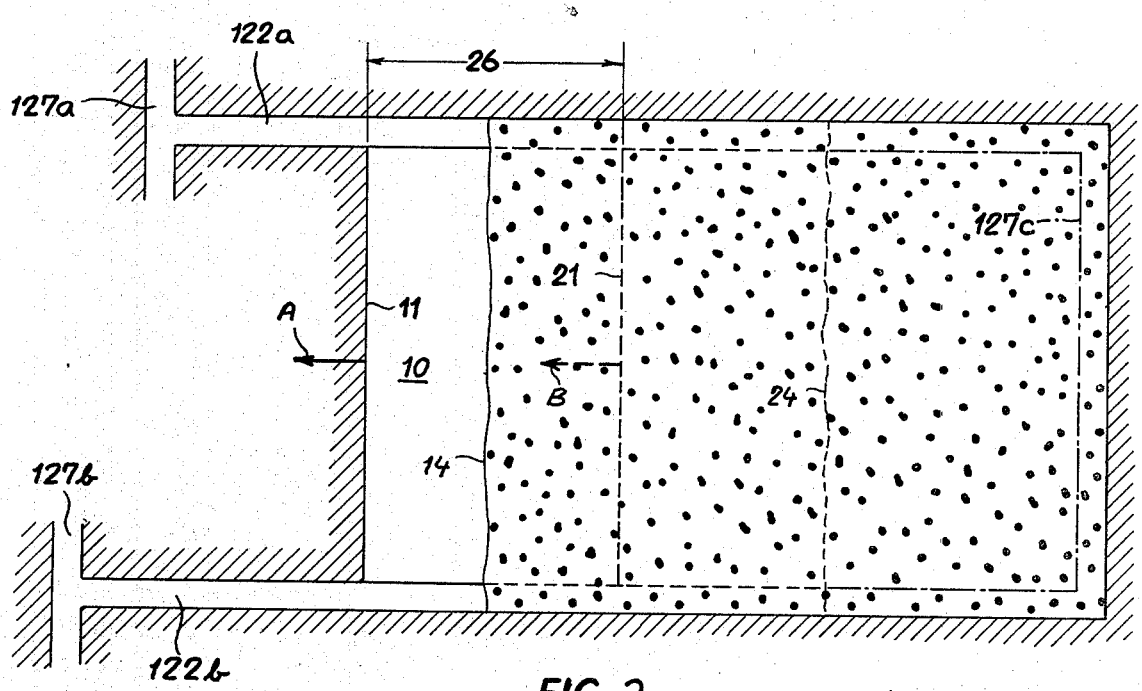
FIG. 2 is a similar plan view illustrating a somewhat different mode of operation.

In FIG. 2 we have schematically illustrated a mode of operation involving rearward excavation at both levels. Thus, two deep drifts 122*a*, 122*b* interconnected by a cross-cut 127*c* are formed around the area to be mined and communicate via cross-cuts 127*a*, 127*b* with the main gallery 8 and with the ventilating duct 9 (cf. FIGS. 3 and 4). Upper and lower galleries are installed in these drifts, the upper galleries being buried by the progressive cave-in of the upper stope. These galleries, therefore, are abandoned upon the excavation of the lower bench. The two faces 11 and 21 again advance, as indicated by arrows A and B, with a separation 26. The consolidating layer 6 (FIG. 5), advancing generally at the same rate as the upper face 11, also extends above the lower galleries in drifts 122*a* and 122*b*. The layout of FIG. 2 enables the mining of a coal vein having a depth of about 4.5 to 6 meters, possibly even up to 7 meters with the use of digging equipment protected by a tall shield.

Figure 3:
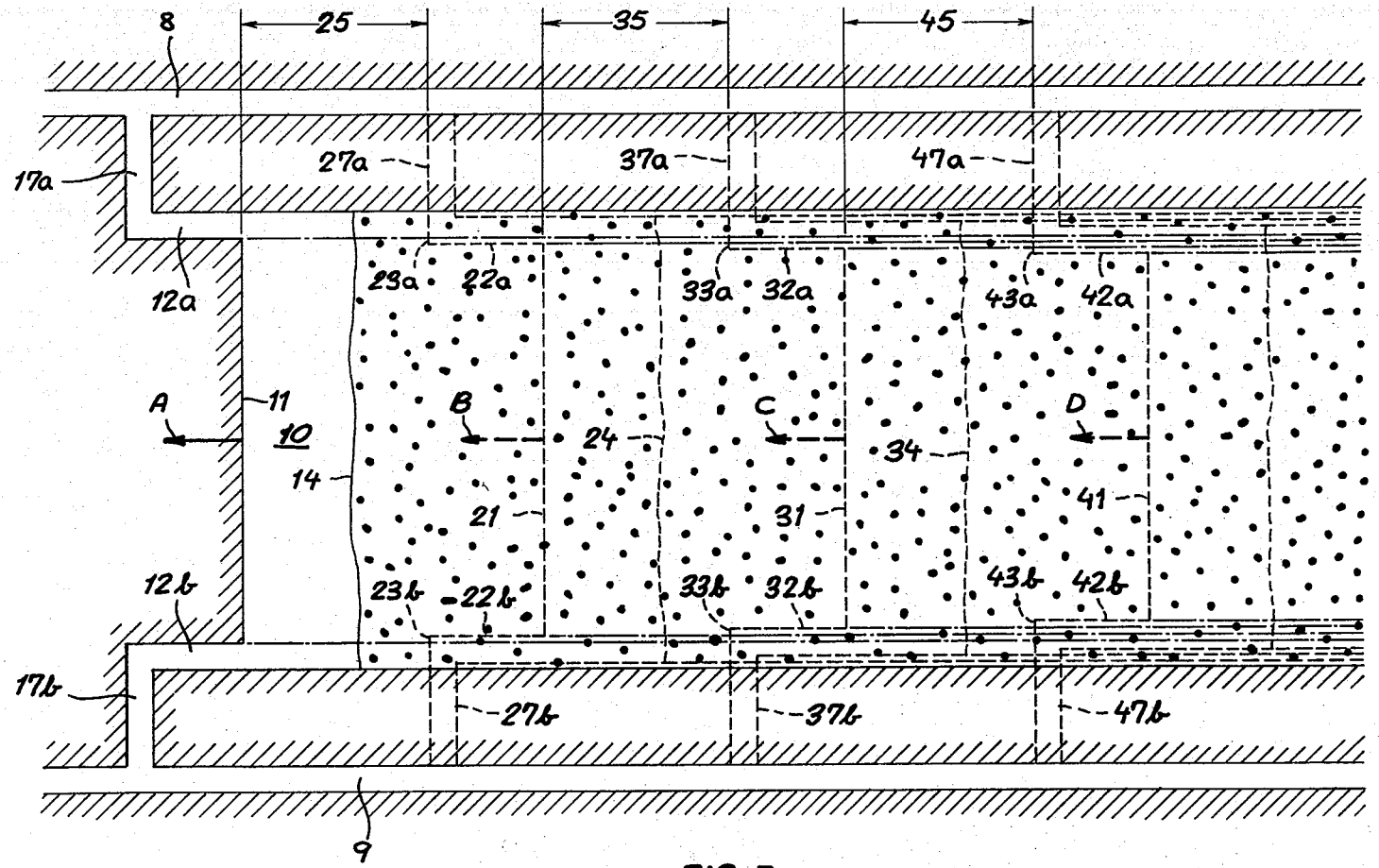
FIG. 3 is a plan view showing excavation of a large-size coal seam in four layers.

FIG. 3 shows four mine faces 11, 21, 31 and 41 advancing, as respectively indicated by arrows A, B, C and D, on progressively lower levels for the mining of a very deep and long seam. In this instance, after consolidation of the caved-in part 14 of the uppermost stope, cross-cuts 27*a*, 27*b* are formed at a distance 25 from face 11 to mark the starting points 23*a*, 23*b* of the next pair of parallel galleries 22*a*, 22*b* to be dug preparatorily to excavation of the second bench. When the corresponding stope has caved in on a supporting cementitious layer over an area 24, further cross-cuts 37*a* and 37*b* are made at a distance 35 from face 21 to mark the starting points 33*a*, 33*b* of the next-lower pair of galleries 32*a*, 32*b*. After the third stope has caved in and consolidated in an area 34, additional cross-cuts 47*a*, 47*b* are made at a distance 45 from face 31 to mark the starting points 43*a*, 43*b* of galleries 42*a*, 42*b* at the fourth level, preparatorily to the excavation of the lowermost bench.

FIG. 4 shows a combination of the methods represented by FIGS. 2 and 3, with formation of two pairs of deep drifts 122*a*, 122*b* to accommodate the galleries of the two upper levels and a similar pair of drifts 342*a*, 342*b* for the galleries of the two lower levels. The latter drifts communicate with main gallery 8 and ventilation duct 9 via cross-cuts 37*a* and 37*b*, respectively. Faces 11 and 21 of the two upper benches are separated by a distance 26 whereas faces 31 and 41 of the two lower benches are separated by a distance 36; the separation of cross-cuts 37*a* and 37*b* from face 21 has been designated 35.

We claim:

1. A method of mining heavy coal seams to be excavated in a plurality of benches at different levels, comprising the steps of:

(a) excavating an upper bench with formation of a stope in the wake of excavation while supporting the roof of the stope so formed by temporary props;

(b) introducing a cementitious slurry into said stope in a minimum amount of substantially 10% of the stope volume, said slurry comprising an aqueous suspension of calcareous matter in a proportion of substantially 10 to 60% by weight, to form a pool of said slurry at the bottom of the stope;

(c) withdrawing the roof-supporting props at a certain distance behind an advancing face of the excavation to enable a cave-in of overburden above the stope whereby fragmented waste rock from said overburden accumulates at the bottom of the stope and is engulfed by the slurry of said pool;

(d) allowing said slurry and said waste rock to harden into a solid layer;

(e) excavating a next-lower bench under the solid layer thus formed; and (f) repeating steps (b), (c) and (d) with every stope to be undermined by a further excavation at a lower level.

2. A method as defined in claim 1 wherein said slurry is admixed with a chloride of at least one alkali or alkaline-earth metal in a proportion between substantially 0.3% or 6% by weight with reference to the water of said suspension.

3. A method as defined in claim 2 wherein the proportion of the admixed chloride ranges between substantially 0.8% and 3%, by weight, of the water.

4. A method as defined in claim 1, wherein the proportion of said calcareous matter ranges between substantially 20% and 40%, by weight, of the water.

5. A method as defined in claim 1, 2, 3 or 4 wherein said slurry is introduced in step (b) in an amount ranging between substantially 20% and 25% of the volume of the stope.

6. A method as defined in claim 1, 2, 3 or 4 wherein ceramic aggregates of large specific surface are added to said slurry in an amount between substantially 5% and 30% by weight.

7. A method as defined in claim 6 wherein the amount of said aggregates ranges between substantially 15% and 20% of the weight of said slurry.

8. A method as defined in claim 1, 2, 3 or 4, comprising the further step of mechanically agitating the fragmented waste rock engulfed by said slurry in step (c).

9. A method as defined in claim 1, 2, 3 or 4 wherein excavations at successively lower levels follow one another with delays corresponding to the hardening time in step (d).

10. A method as defined in claim 9 wherein said hardening time is on the order of one month.

11. A method as defined in claim 9 wherein step (a) is preceded by the building of a gallery common to said upper bench and to said next-lower bench, the part of said gallery at the level of said upper bench being flooded with said slurry in step (b) and being abandoned in step (e).

* * * * *